United States Patent [19]

Comstock

[11] Patent Number: 4,608,011

[45] Date of Patent: Aug. 26, 1986

[54] CANDLE APPARATUS

[76] Inventor: Todd M. Comstock, P.O. Box 1671, Cotuit, Mass. 02635

[21] Appl. No.: 604,896

[22] Filed: Apr. 27, 1984

[51] Int. Cl.[4] ..... F23D 3/18

[52] U.S. Cl. ..... 431/324; 431/320; 431/125; 362/810

[58] Field of Search ..... 431/125, 288, 291, 320, 431/321, 324; 362/810

[56] References Cited

U.S. PATENT DOCUMENTS

| | | | |
|---|---|---|---|
| 2,749,733 | 6/1956 | Smith et al. | 431/125 X |
| 3,081,612 | 3/1963 | Roscovich | 431/125 X |
| 3,097,514 | 7/1963 | Stone | 431/324 X |
| 3,697,739 | 10/1972 | Novak et al. | 431/324 X |

*Primary Examiner*—Margaret A. Focarino

*Attorney, Agent, or Firm*—Wolf, Greenfield & Sacks

[57] ABSTRACT

A candle apparatus for providing a candle-like flame and candle effect and employing a liquid that may be of petroleum product type or non-petroleum product type functioning as a source for the flame in combination with a wick that is soaked in the liquid. The apparatus comprises a base member having a base opening and a canister for the liquid. A shell extends over the base and canister. The shell is easily removable and also interacts with the canister to support the canister in its proper position.

7 Claims, 2 Drawing Figures

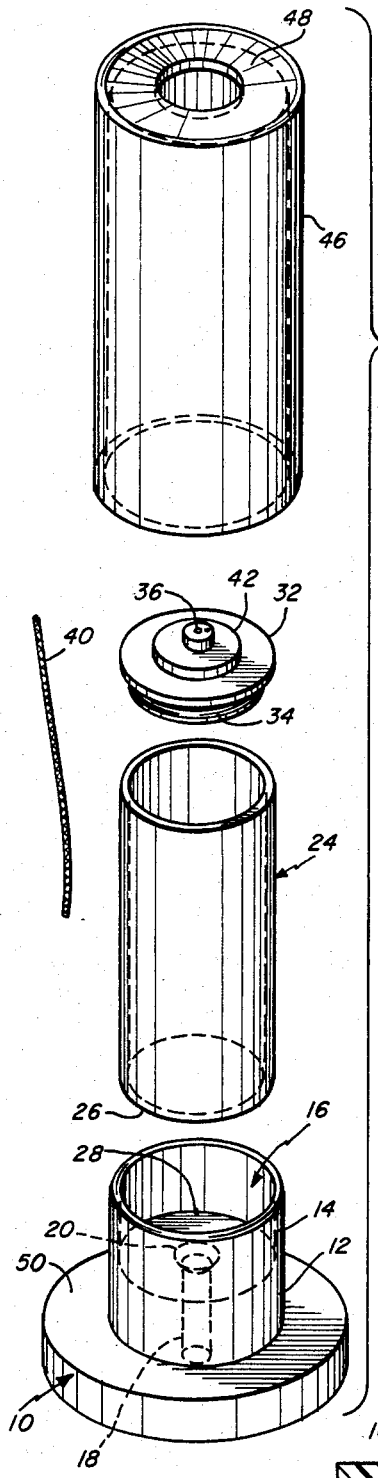
Fig. 1
Fig. 2
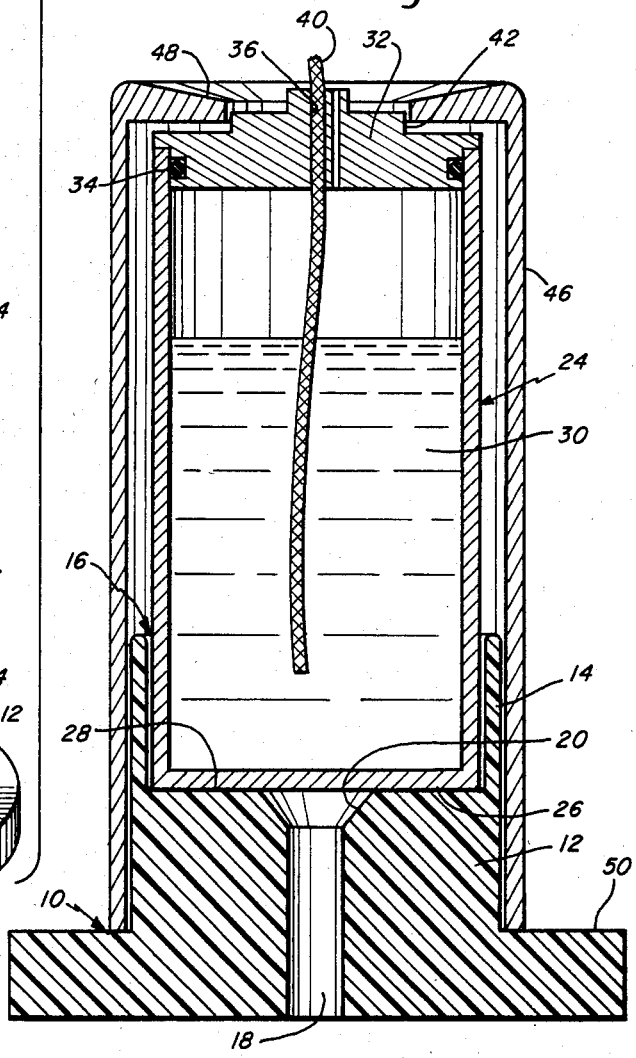

CANDLE APPARATUS

BACKGROUND OF THE INVENTION

The present invention relates in general to a candle apparatus. More particularly, the present invention is concerned with an improved functional and decorative lighting means that is adapted to have the appearance of a candle with its associated candle-like flame but in which the flame and associated lighting is produced from a liquid source which may be a petroleum or non-petroleum product.

It is an object of the present invention to provide an improved candle apparatus that is safe to operate, relatively easy to maintain and which provides a candle-like flame and appearance.

Another object of the present invention is to provide an improved candle apparatus in accordance with the preceding object, and in which the liquid container may be easily removed and/or replaced.

Still a further object of the present invention is to provide an improved candle apparatus in accordance with the preceding objects, and which is readily adaptable to being configured into different sizes and shapes, having in particular, a universal base construction.

SUMMARY OF THE INVENTION

To accomplish the foregoing and other objects, features and advantages of the invention, there is provided a candle apparatus that comprises a base having means defining a base opening. The base opening is for receiving a canister. The canister contains the liquid that is to be burned. This liquid may be a petroleum product but is preferably a vegetable oil based product. The canister has a removable top cap with sealing means associated therewith. A wick or the like extends from the canister through the cap and it is the wick that is lighted to produce the candle-like flame. Over the canister and the base is fitted an external shell that substantially covers the canister and also extends about a platform on the base. The base may have associated therewith, some means by which the base and thus the entire candle apparatus can be supported from a larger base or other structure from which the candle apparatus is to be supported.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is an exploded perspective view of the candle apparatus of the present invention; and FIG. 2 is a cross-sectional view taken through the candle apparatus of the present invention with the canister and shell in position in use.

DETAILED DESCRIPTION

Reference is now made to the drawing which illustrates in FIG. 1 an exploded perspective view of a preferred embodiment of the candle apparatus of the present invention. FIG. 2 shows a cross-sectional view with all of the parts of the apparatus in their assembled position in use. The apparatus of the present invention comprises a base 10 having extending upwardly therefrom, a platform 12 which in turn has extending upwardly therefrom, an annular wall 14 defining a base opening 16. Through the base 10 and integral platform 12, there is provided a centrally disposed passage 18 which is preferably countersunk as indicated at 20. This passageway may be for receiving a wood screw or the like.

The base 10 is constructed preferably of a plastic material and the passage 18 for receiving the wood screw may provide a means by which the base can be fastened to another member not shown herein. For example, the base 10 may be secured to a larger base member to provide additional stability to the candle apparatus.

As indicated in FIG. 2, in the cross-sectional view, it is preferred that the base 10 and platform 12 be substantially solid with the exception of the passageway 18. This provides for sufficient weight to the base member. In addition, weights might be provided in the base member to provide additional stability for the overall candle apparatus. However, for the most part, the provision of a solid plastic base and platform provides sufficient weight to provide good stability to the candle apparatus.

The candle apparatus of this invention also comprises a canister 24 which is of cylindrical construction with the outer diameter thereof dimensioned so as to snugly fit within the base opening 16 defined by the annular wall 14. This snug fitting is illustrated in the cross-sectional view of FIG. 2. The bottom wall 26 of the canister rests upon the top wall 28 of the platform 12.

The canister 24 adapts to contain a liquid 30. This liquid 30 may be a petroleum product such as Nopar 15, but is preferably a vegetable oil base product.

The canister 24 is sealed at the top by means of a cap 32 which is fitted with an O-ring 34 which provides a tight seal between the cap 32 and the top periphery of the canister 24. It is noted that the cap 32 is also provided with a centrally disposed passage 36 through which extends the wick 40. FIG. 2 shows a small segment of the wick 40 extending outwardly of the passage 36. It is also preferred that the top of the cap 32 be arranged in a step configuration as noted in FIG. 2. One of the steps in the top of the cap 32 forms a shoulder 42 which is a limiting means relative to the outer shell 46.

As just indicated, the remaining portion of the candle apparatus comprises a shell 46 which is generally of cylindrical shape, totally open at the bottom and having an annular flange 48 at the top thereof directed inwardly. It is noted that the shell 46 is conveniently aligned with the canister and with the cap 32 by means of interaction of the flange 48 with the shoulder 42. This tends to position the components properly and in particular positions, the canister 24 in its proper vertical orientation.

The shell 46 at its bottom end rests upon the surface 50 of the base. As indicated previously, the fit between the canister and the annular wall 14 is snug. Also, there is preferably a relatively snug fit between the shell 46 and the outer surface of the annular wall 14 extending downwardly to the base 10.

It is noted in accordance with the unique candle apparatus of this invention that, in order to replace the canister 24 or in order to refill it, one simply has to remove the shell 46. When this is removed, then the canister 24 is readily accessible. The canister 24 may then be removed from the base opeing 16 and then may be replaced or refilled.

For the purpose of refilling, the cap 32 is relatively easily removed and additional liquid can be added to the canister. The canister is then replaced in the base opening 16 and the shell 46 is then inserted over the canister and base. Once again, proper alignment is provided by the interaction at the top of the cap between the shoulder 42 and the periphery of the flange 48 of the shell 46. The flange 48 actually provides a hole which is of slightly greater diameter than the diameter at the annular shoulder 42.

Having described one embodiment of the present invention, it should now be apparent to those skilled in the art that numerous other embodiments are contemplated as falling within the scope of this invention.

What is claimed is:

1. A candle apparatus comprising;

a base having means defining a base opening formed at least in part by a peripheral wall, a canister for containing a liquid that is to be burned, said canister having cap means with a passage therethrough for receiving a wick which is adapted to extend into the liquid and also extend at least partially out of the canister, said canister having a base adapted to be received in said base opening, and a shell which is adapted to extend over said canister and base peripheral wall and having an opening defined in the top thereof so as to leave said cap means and wick exposed, said base including a base member and integral platform extending upwardly from said base member, said platform being of a smaller diameter than said base member, said peripheral wall being an annular wall that extends upwardly from said platform to define said base opening, said base having, outwardly of the platform, a substantially flat and continuously annular shell resting surface, said shell, about its bottom annular edge, resting upon the base flat surface, extending below the lowermost part of the canister and covering the platform, annular wall and canister.

2. A candle apparatus as set forth in claim 1 wherein said cap means is a separate cap from the canister having associated therewith a sealing means for preventing any liquid from escaping from the canister.

3. A candle apparatus as set forth in claim 2 wherein said sealing means comprises an O-ring carried by said cap.

4. A candle apparatus comprising;

a base having means defining a base opening formed at least in part by a peripheral wall, a canister for containing a liquid that is to be burned, said canister having cap means with a passage therethrough for receiving a wick which is adapted to extend into the liquid and also extend at least partially out of the canister, said canister having a base adapted to be received in said base opening, and a shell which is adapted to extend over said canister and base peripheral wall and having an opening defined in the top thereof so as to leave said cap means and wick exposed, said base including a base member and integral platform extending upwardly from said base member, said platform being of a smaller diameter than said base member, said peripheral wall being an annular wall that extends upwardly from said platform to define said base opening, said base having, outwardly of the platform, a substantially flat shell resting surface, said shell, about its bottom annular edge, resting upon the base flat surface, extending below the lower most part of the canister and covering the platform, annular wall and canister and, wherein said cap means has a top shoulder and said top opening of the shell interacts with said shoulder to form a guiding means between the shell and canister.

5. A candle apparatus comprising;

a base having means defining a base opening formed at least in part by a peripheral wall, a canister for containing a liquid that is to be burned, said canister having cap means with a passage therethrough for receiving a wick which is adapted to extend into the liquid and also extend at least partially out of the canister, said canister having a base adapted to be received in said base opening, and a shell which is adapted to extend over said canister and base peripheral wall and having an opening defined in the top thereof so as to leave said cap means and wick exposed, said base including a base member and integral platform extending upwardly from said base member, said platform being of a smaller diameter than said base member, said peripheral wall being an annular wall that extends upwardly from said platform to define said base opening, said base having, outwardly of the platform, a substantially flat shell resting surface, said shell, about its bottom annular edge, resting upon the base flat surface, extending below the lower most part of the canister and covering the platform, annular wall and canister and, wherein the canister, annular wall and shell are concentrically arranged with the spacing between the canister and shell being on the order of but slightly greater than the annular wall thickness.

6. A candle apparatus as set forth in claim 5 wherein said shell has an upper inwardly directed annular flange defining the shell top opening.

7. A candle apparatus as set forth in claim 6 wherein the shell top opening is located heightwise at substantially the same location as the top of the canister.

* * * * *